United States Patent [19]

Zehren

[11] 4,352,394

[45] Oct. 5, 1982

[54] CABLE-SUSPENDED WELL PUMPING SYSTEMS

[75] Inventor: James N. Zehren, Bartlesville, Okla.

[73] Assignee: TRW Inc., Cleveland, Ohio

[21] Appl. No.: 174,616

[22] Filed: Aug. 1, 1980

[51] Int. Cl.[3] ..... E21B 33/128

[52] U.S. Cl. ..... 166/106; 166/120; 166/133; 166/217

[58] Field of Search ..... 166/106, 120, 138, 212, 166/217, 137, 133

[56] References Cited

U.S. PATENT DOCUMENTS

| | | | |
|---|---|---|---|
| 2,121,050 | 6/1938 | Ragan et al. | 166/13 |
| 2,286,365 | 6/1942 | Lane | 103/219 |
| 2,350,973 | 6/1944 | Brumleu et al. | 103/219 |
| 2,373,005 | 4/1945 | Baker | 166/12 |
| 2,711,795 | 6/1955 | Ragan | 166/120 |
| 2,929,453 | 3/1960 | Conrad | 166/134 |
| 2,963,091 | 12/1960 | Conrad | 166/118 |
| 3,191,682 | 6/1965 | Cochran | 166/120 |
| 3,209,832 | 10/1965 | Tausch | 166/138 |
| 3,364,997 | 1/1968 | Current | 166/134 |
| 3,378,078 | 4/1968 | Current | 166/124 |
| 3,399,726 | 9/1968 | Harris et al. | 166/42 |
| 3,456,723 | 7/1969 | Current et al. | 166/120 |
| 3,468,258 | 9/1969 | Arutunoff | 103/87 |
| 3,556,220 | 1/1971 | Schwegman | 166/290 |
| 3,714,983 | 2/1973 | Wilson | 166/120 |
| 3,750,749 | 8/1973 | Giroux | 166/95 |
| 3,785,436 | 1/1974 | Davis, Jr. | 166/120 |
| 3,807,894 | 4/1974 | O'Rourke | 415/147 |
| 3,977,473 | 8/1976 | Page, Jr. | 166/315 |
| 4,044,826 | 8/1977 | Crowe | 166/120 |
| 4,059,150 | 11/1977 | Manderscheid | 166/120 |

*Primary Examiner*—James A. Leppink

*Attorney, Agent, or Firm*—Shapiro and Shapiro

[57] ABSTRACT

A packer assembly for a cable-suspended well pumping system comprises a cylindrical housing carrying an external sealing sleeve of resilient material and a series of axially movable radially expandable slips for gripping a well casing. The slips are operated by liquid pressure developed upon initiation of a downwell pumping operation, by movement of a tubular piston within the housing which is connected to the slips through openings in the housing wall. Further, the slips abut a collar attached to one end of the sealing sleeve so that axial movement of the slips also causes the sealing sleeve to be axially compressed and radially expanded into engagement with the well casing. After pumping is terminated, the slips and seal can be disengaged from the well casing simply by raising the assembly.

14 Claims, 2 Drawing Figures

CABLE-SUSPENDED WELL PUMPING SYSTEMS

BACKGROUND OF THE INVENTION

Cable-suspended oil-well pumping systems which dispense with the need for using a pipe-string connected to the pump discharge, for conveying pumped oil to the earth surface, are known. (See for example, U.S. Pat. No. 3,468,258 issued Sept. 23, 1969 to Arutunoff and commonly assigned herewith). Such systems may employ a packer assembly which engages with the well casing to provide a seal between the low pressure and high pressure sides of the system, so that oil can be pumped to the surface directly through the well casing. The packer assembly, apart from providing a liquid seal between the high and low pressure sides, may also carry externally toothed slips which, when the assembly is suitably positioned down a well, are expanded radially into gripping contact with the casing, to afford support both for the weight of the downwell assembly and for the weight of liquid above the assembly. It is further known for such slips to be expanded automatically by hydraulic pressure created in response to iniation of the pumping operation.

SUMMARY OF THE INVENTION

The present invention relates to a packer assembly for a cable-suspended well pumping system and more particularly to improvements in the slip-setting and packer seal arrangements of such an assembly.

It is an object of the invention to provide a packer assembly for a cable-suspended well pumping system having novel means for automatically setting the slips on initiation of a pumping operation.

A further object of the invention is to provide a packer assembly for a cable-suspended pumping system, which has a radially expandable and retractable seal which is automatically expanded into sealing contact with a well casing on initiation of pumping.

Another object of the invention is to provide a packer assembly having a radially expandable and retractable packer seal and slips, wherein radial expansion and retraction of the seal is directly responsive to movement of the slips.

Yet another object of the invention is to provide a packer assembly having automatically operable expandable and retractable seal means and slips.

Still another object of the invention is to provide a packer assembly having radially expandable and retractable seal means and slips which are automatically retracted responsive to lifting of the assembly on termination of pumping.

With the above and other objects in view, the invention in one preferred form provides a packer assembly generally in the form of a cylindrical housing having a liquid inlet end, a liquid outlet end, an external radially expandable and retractable seal means and slips, and means interiorly of the housing responsive to fluid pressure established upon initiation of a downwell pumping operation for automatically effecting radial expansion of the slips and seal means into engagement with the well casing. Preferably, the fluid pressure responsive means comprises a sleeve movable piston-wise in the housing and being connected to the slips by pivoted linkages extending through axial openings in the housing which are covered by the sleeve. The interior of the sleeve forms a flow path for liquid between the inlet and outlet ends of the housing and a poppet-type valve is associated with the sleeve to establish suitable differential pressure conditions within the housing for causing the sleeve to move upon initiation of pumping, to radially expand the slips, and allowing the assembly to be raised relative to the sleeve and slips upon termination of pumping so as to release the slips from the well casing and allow the pumping apparatus to be withdrawn from the well.

In accordance with a further preferred feature of the invention, the packer assembly has an external seal in the form of a sleeve of resilient material, such as rubber, one end of which is fixed relative to the housing and the other end of which is attached to a collar or the like axially slidably mounted on the housing, so that axial compression of the sleeve by movement of the collar on the housing effects radial expansion of the sleeve into sealing engagement with a surrounding well casing. Movement of the collar to axially compress the resilient sleeve is conveniently effected by direct abutment of the collar against the aforedescribed slips, so that as the slips are moved into gripping engagement with the casing, radial expansion of the sealing sleeve occurs simultaneously. When the assembly is raised upon termination of pumping, to release the slips from the casing the collar is freed for axial movement down the housing so that the seal is radially retracted.

Fully automatic setting of both the slips and packer seal is thereby obtained in an assembly according to the invention, responsive to the initiation of a downwell pumping operation and, upon termination of pumping, the assembly can be raised to release both the seal and slips.

A preferred embodiment of the invention will be described, by way of example only, with reference to the accompanying drawings.

DESCRIPTION OF PREFERRED EMBODIMENT

Figure 1:
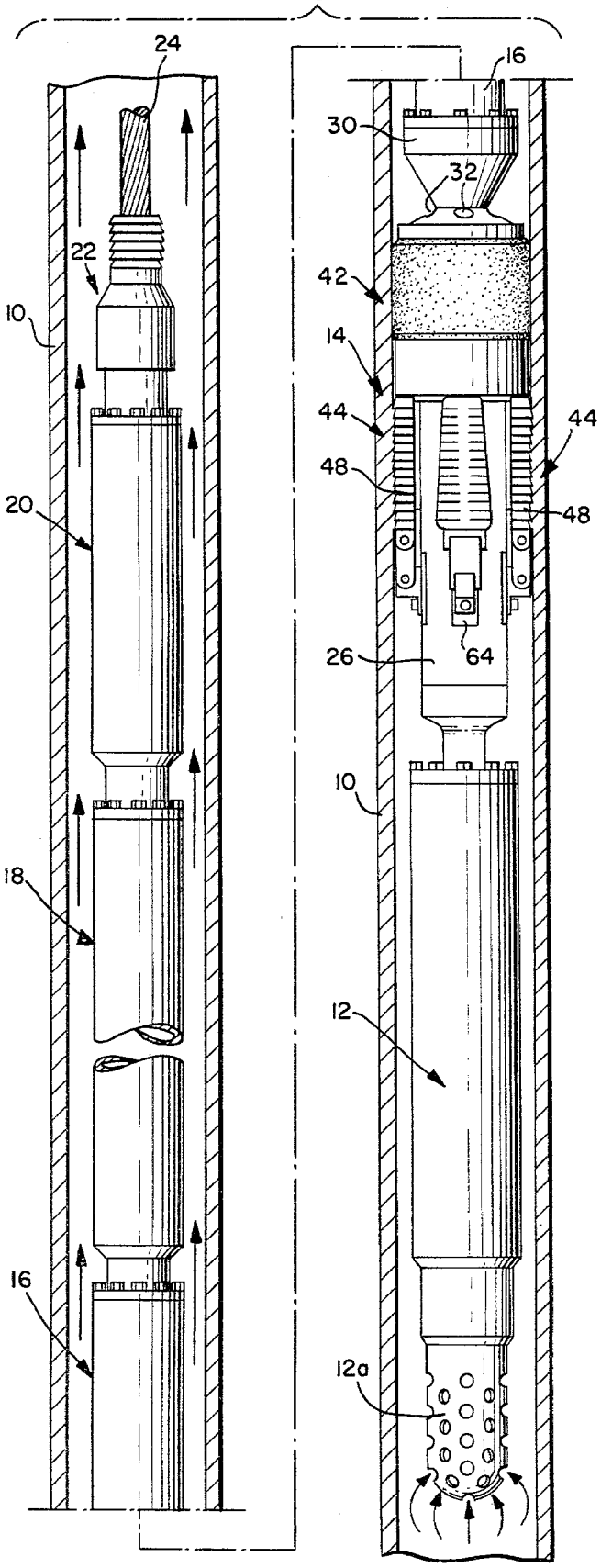
FIG. 1 is an elevational view of a cable-suspended oil well pumping system, shown in pumping position in a well casing.

FIG. 1 shows a cable-suspended oil well pumping system in pumping position in a well casing 10, the system including a submergible pump 12 (preferably of the centrifugal type), with intake means 12*a* at its lower end, a packer assembly 14 connected to the pump discharge head, a motor protector 16 above the packer assembly , an electric drive motor 18 for the pump, a balance pack-off chamber 20, and a cable anchor 22. A suspension cable for the system is shown at 24. It will be understood that motor 18 drives pump 12 through suitable shafting extending axially through protector 16 and packer assembly 14, and part of which shafting is shown in detail in FIG. 2. Electric leads for motor 18 may conveniently extend through cable 24 and balance chamber 20 in known manner. Pump 12, protector 16, motor 18, balance chamber 20 and cable anchor 22 are all of conventional design and will not be described herein in detail, the invention being concerned with the construction of packer assembly 14, shown in greater detail in FIG. 2.

Figure 2:
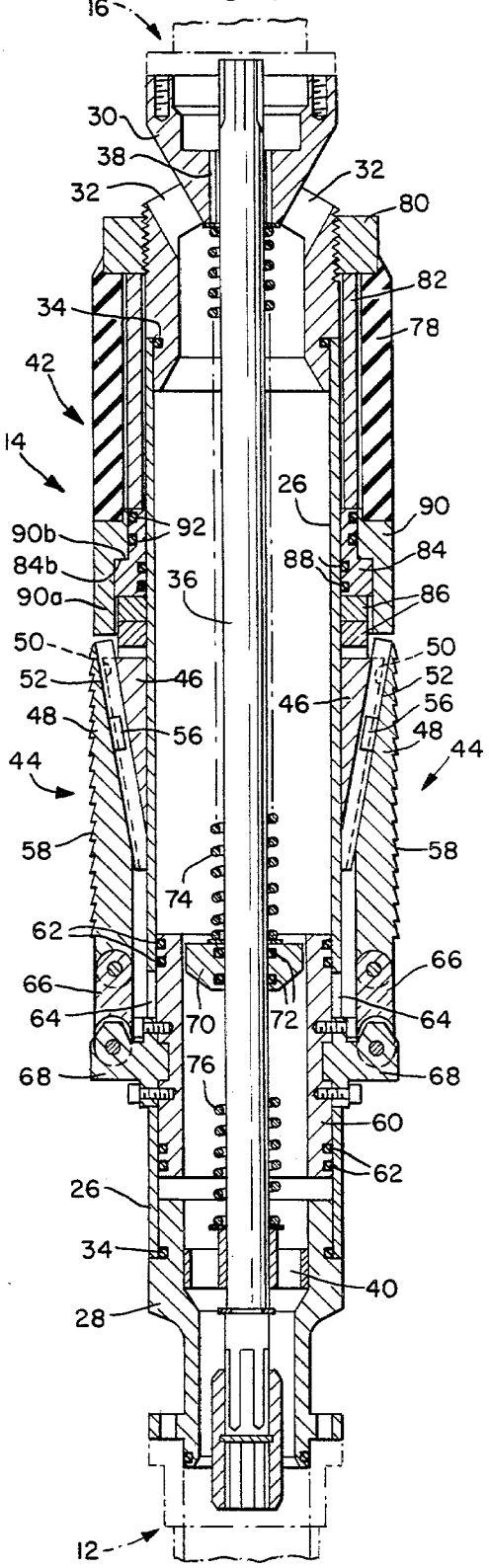
FIG. 2 is a detailed sectional elevation of a packer assembly in accordance with the invention, as used in the system shown in FIG. 1.

As illustrated, packer assembly 14, includes a cylindrical housing 26, attached at its lower end to a base member 28 defining a liquid inlet, and which, as shown in phantom line in FIG. 2, is, in use, attached to the outlet end of pump 12. At its upper end, housing 26 is attached to a head member 30 attached to motor protector 16 and provided with liquid outlets 32. Head member 30 constitutes the pump discharge head. O-ring liquid seals 34 are provided between housing 26 and the head and base members, respectively. A shaft 36 extends axially through housing 26 and is supported in a bearing 38 in head member 30 and at its lower end in a spider bearing 40. Shaft 36 forms part of the drive connection between motor 18 and pump 12 and is, in use, connected to the pump shaft and a shaft extending through motor protector 16.

Exteriorly of housing 26, packer assembly 14 carries a resilient seal means generally indicated by reference 42 and four circumferentially spaced slip assemblies 44 below the seal means, two of which assemblies are shown in detail in FIG. 2. Each slip assembly 44 is of generally known type and includes a slip body member, or shoe 46, fixed to the outside of casing 26 and a moving slip 48. The respective slip body members 46 and slips 48 have interengaging inclined ramp surfaces 50, 52 and ramp surfaces 50 of body members 46 each have a vertical guideway receiving a projecting guide 56 on the respective slip. With this arrangement, axial movement of the slips along the body members effects radial expanding and retracting movement of the slips, in known manner. Each slip is further provided with conventional external gripping teeth 58.

A sleeve 60 is mounted piston-wise in the lower end of housing 26, with suitable sealing rings 62 provided between the sleeve and housing. Sleeve 60 covers a series of four circumferentially spaced, axially extending openings or slots 64 in housing 26, such openings being aligned with the respective slip assemblies. Each of the slips 48 is connected to sleeve 60 by means of a pivoted link 66 and a bracket 68 attached to the sleeve and projecting through an opening 64. Accordingly, upward movement of sleeve 60 in housing 26 from the position shown in FIG. 2, is effective to move slips 48 up the body members 46 and effect radial expansion of the slips. Movement of sleeve 60 is limited by the relative heights of openings 64 and brackets 68.

Shaft 36 carries a poppet valve member 70 having a sliding fit on the shaft, with interposed seal rings 72, and a first coil compression spring 74 surrounds the shaft and acts between valve member 70 and head bearing 38. The length of spring 74 is such that in the extended, unstressed condition of the spring, valve member 70 is located in the top of sleeve 60 when the sleeve is in its lowermost position as shown in FIG. 2. Valve member 70 is a loose fit in sleeve 60 and closes off the interior of sleeve 60 which defines part of the liquid flow path through the housing 26. A second coil compression spring 76, of shorter length than spring 74, surrounds shaft 36 below valve member 70, its end resting on spider 40.

Seal means 42 consists of a sealing sleeve 78 of resilient material such as rubber, surrounding the upper end of housing 26. The upper margin of sleeve 78 is molded into or suitably bonded to a ring 80 screwed onto the exterior of head member 30. Axial positioning of ring 80 is determined by a spacer tube 82, a lower ring 84 supporting tube 82, and spacer shims or like packing elements 86 interposed between the upper surfaces of slip body members 46 and ring 84. Sealing rings 88 are provided between ring 84 and the exterior of housing 26. The lower margin of sleeve 78 is bonded to a collar 90 axially movable on ring 84 with interposed seals 92. Collar 80 has a depending skirt portion **90*a*, the lower rim of which, in the relaxed condition of sleeve 78, is situated immediately above the upper edges of slips 48. Collar 90 and ring 84 have engageable shoulders 90*b* and 84*b*, respectively. The provision of packing means 86 and the screw adjustability of ring 80**, provides suitable tolerance for obtaining this positioning of the seal components.

Operation of the packer assembly will now be described. In its rest position, the configuration of the packer assembly is as shown in FIG. 2 and in this condition of the assembly, the entire pumping apparatus is lowered into a well, to pumping position as shown in FIG. 1.

On initiation of pumping, liquid under pressure from pump 12 enters housing 26 through base member 28 urging valve member 70 against spring 74. The liquid, however, is effectively prevented from flowing through the housing by the presence of valve 70 in the sleeve 60, although a small amount may leak around the valve. Pressure accordingly builds up beneath valve 70 and sleeve 60 resulting in a pressure differential between the upper and lower ends of sleeve 60 sufficient to cause preferential upward movement of sleeve 60 in housing 26. Valve 70 is still retained in blocking position within sleeve 60 by spring 74, the force of the spring being appropriately chosen to provide such action.

Upward movement of sleeve 60 in housing 26 is accompanied by upward movement and radial expansion of slips 48 so that teeth 58 are brought into engagement with well casing 10. Simultaneously, by abutment of the upper surfaces of slips 48 against skirt portion **90*a* of collar 90, the collar is moved upwardly, thereby bowing sealing sleeve 70 outwardly into engagement with well casing 10**.

When liquid pressure under valve member 70 is sufficient to overcome the force of spring 74, valve member 70 is lifted out of sleeve 60 against the spring force, thereby establishing a flow path through housing 26, and liquid is pumped. The weight of liquid above the packer assembly causes teeth 58 to grip well casing 10 in known manner, to support the apparatus.

Upon termination of pumping, pressure below valve member 70 is released and the weight of the pumped liquid above the valve member moves it down towards the lower end of sleeve 60 against spring 76, the sleeve still being in its upper position in housing 26. Pressure equalization is achieved by liquid seeping past valve 70. The assembly can then be lifted relative to the stationary slips, thereby releasing their grip against well casing 10 and simultaneously allowing return of sealing sleeve 78 to its relaxed position by axial movement of collar 90.

It will be appreciated from the foregoing that the invention provides a retractable packer assembly for downwell pumping applications, which includes convenient means whereby both the slips and sealing means are set automatically upon initiation of pumping and released upon termination of pumping by raising of the assembly. Further, while the invention has been particularly described in relation to a cable-suspended oil well pumping system which dispenses with a downwell pipe string, the principles of the invention can be applied to other types of well pumping systems and the invention is not intended to be limited to the particular application described.

While only a single preferred embodiment of the invention has been described herein in detail, it will be understood that the invention is not limited thereby and modifications can be made within the scope of the attached claims.

I claim:

1. A packer assembly for a well pumping system comprising a cylindrical housing having a liquid inlet end and a liquid outlet end, packing means carried exteriorly of said housing for cooperation with a well casing, said packing means including at least two circumferentially spaced, axially movable slips and cooperating slip-body means fixed relative to said housing, said slips and said slip-body means having interengaging ramp surfaces for effecting radial expansion and retraction of said slips by axial movement of said slips on said slip-body means, a sleeve means mounted piston-wise within said housing for axial movement therein, the interior of said sleeve means defining part of a flow path for liquid between said inlet and outlet ends of said housing, axially extending openings in said housing, link means extending through said openings connecting the respective slips to said sleeve means for movement of said slips on said slip-body means responsive to movement of said sleeve means in said housing, and means for creating a differential pressure in said housing between opposite ends of said sleeve means upon admission of liquid to said inlet end of said housing for axially moving said sleeve means in said housing in a direction providing radially expanding movement of said slips on said slip-body means.

2. The assembly as defined in claim 1, wherein said means creating a differential pressure in said housing includes valve means for inhibiting liquid below a predetermined pressure from flowing through said sleeve means from said inlet end of said housing to said outlet end of said housing.

3. The assembly as defined in claim 2, wherein said valve means includes a movable valve member, and biasing means urging said valve member into the interior of said sleeve means to inhibit liquid flow therethrough, and wherein said valve means is movable out of said sleeve means when the pressure of liquid within said sleeve means is sufficient to overcome said biasing means.

4. The assembly as defined in claim 3, including a shaft extending axially through said housing, said valve member being axially slidably mounted on said shaft.

5. The assembly as defined in claim 4, wherein said biasing means includes coil spring means surrounding said shaft and extending between said outlet end of said housing and said valve member.

6. The assembly as defined in claim 5, including a further coil spring means surrounding said shaft between said inlet end of said housing and said valve member.

7. The assembly as defined in claim 3, wherein said valve member is a loose fit in said sleeve means whereby liquid can leak past said valve member when said valve member is located in said sleeve means.

8. The assembly as defined in claim 1, wherein said packing means includes a resilient packing sleeve surrounding said housing, means fixing one end of said packing sleeve relative to said housing, a collar means surrounding said housing and connected to the other end of said packing sleeve, said collar means being axially movable relative to said housing and means providing abutting contact between said collar means and said slips for moving said collar means in a direction axially contracting and radially expanding said sealing sleeve responsive to radial expanding movement of said slips.

9. A packer assembly for a well pumping system comprising a generally cylindrical packer housing, packing means carried exteriorly of said housing for cooperation with a well casing, said packing means including at least two circumferentially spaced axially movable slips and cooperating slip-body means fixed relative to said housing, said slips and said slip-body means having interengaging ramp surfaces for effecting radial expansion and contraction of said slips by axial movement of said slips on said slip-body means, means associated with said assembly for moving said slips on said slip-body means in a direction radially expanding said slips, and said packing means further including a resilient packing sleeve surrounding said housing, means fixing one end of said packing relativve to said housing, a collar means surrounding said housing and connected to the other end of said packing sleeve, said collar means being axially movable relative to said housing, and means providing abutting contact between said collar means and said slips for moving said collar means in a direction axially contracting and radially expanding said sealing sleeve responsive to radial expanding movement of said slips on said slip-body means.

10. The assembly as defined in claim 9, wherein said means providing abutting contact between said collar means and said slips includes a depending skirt portion on said collar means adapted to engage terminal edge portions of said slips.

11. The assembly as defined in claim 9, wherein said means associated with said assembly for moving said slips includes means internally of said housing responsive to liquid pressure introduced to said housing on initiation of a pumping operation.

12. The assembly as defined in claim 11, wherein said means internally of said housing includes a tubular piston means, said housing including axially extending openings and said assembly further including link means connecting said slips to said piston means through said openings.

13. The assembly as defined in claim 12, including valve means associated with said piston means for creating a differential pressure between opposite ends of said piston means on initiation of a pumping operation causing said piston means to move said slips in a radially expanding direction.

14. The assembly as defined in claim 9, wherein said means fixing said one end of said packing sleeve relative to said housing includes a ring means axially adjustably mounted on said housing and wherein said collar means is supported on a ring surrounding said housing, the assembly further including a first spacer means between said ring means and said ring internally of said sealing sleeve and a second spacer means between said ring and said slip-body means.

* * * * *